US006314903B2

(12) United States Patent
Robinson et al.

(10) Patent No.: US 6,314,903 B2
(45) Date of Patent: Nov. 13, 2001

(54) M-SHAPED BOAT HULL

(75) Inventors: Charles W. Robinson, Santa Fe, NM (US); William F. Burns, III, San Diego, CA (US)

(73) Assignee: Mangia Onda Co., LLC, San Diego, CA (US)

( * ) Notice: Subject to any disclaimer, the term of this patent is extended or adjusted under 35 U.S.C. 154(b) by 0 days.

(21) Appl. No.: 09/750,368

(22) Filed: Dec. 27, 2000

Related U.S. Application Data

(63) Continuation-in-part of application No. 09/399,468, filed on Sep. 20, 1999, now Pat. No. 6,250,245.
(60) Provisional application No. 60/101,353, filed on Sep. 22, 1998.

(51) Int. Cl.[7] ..... B63B 1/32
(52) U.S. Cl. ..... 114/288
(58) Field of Search ..... 114/288, 271, 114/274, 289, 290

(56) References Cited

U.S. PATENT DOCUMENTS 2,989,939 * 6/1961 Tater ..... 114/290
3,702,598 * 11/1972 Szptyman ..... 114/67 A
5,191,849 * 3/1993 Labrucherie et al. ..... 114/290
5,458,078 * 10/1995 Perette ..... 114/288
5,474,014 * 12/1995 Russell ..... 114/288

* cited by examiner

*Primary Examiner*—Stephen Avila
(74) *Attorney, Agent, or Firm*—Loyal McKinley Hanson

(57) ABSTRACT

The present invention relates to a watercraft having a wave suppressing "M-shaped" hull design. The hull comprises a central displacement body flanked by two downwardly extending outer skirts. The outer skirts are attached to the displacement body by planing wings having wing channels. The bow wave is directed into the wing channels, thereby increasing planing efficiency and reducing the effect of such waves on other boats and the shoreline. One embodiment takes the form of a twin-hull catamaran with two M-shaped hulls and four arcuate channels for containing the spiraling bow waves from the two central displacement bodies, thus to increase lateral stability and to suppress boat waves to protect nearby boats and structures at the water/land interface.

24 Claims, 9 Drawing Sheets

Fig. 3A
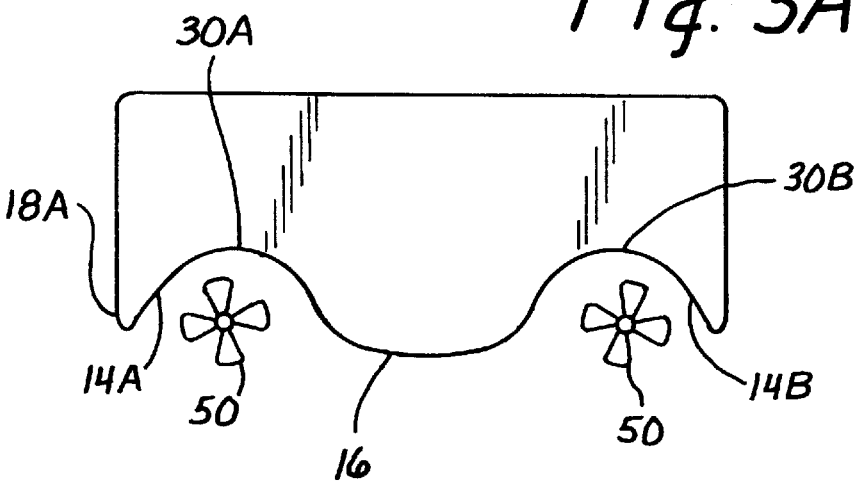
Fig. 3B
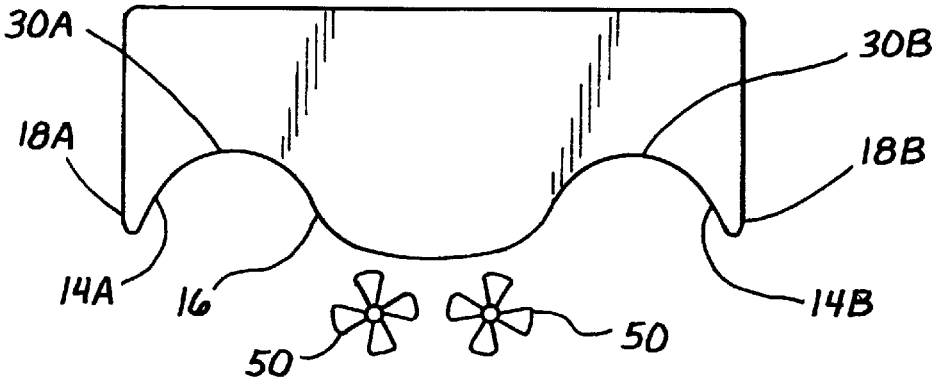
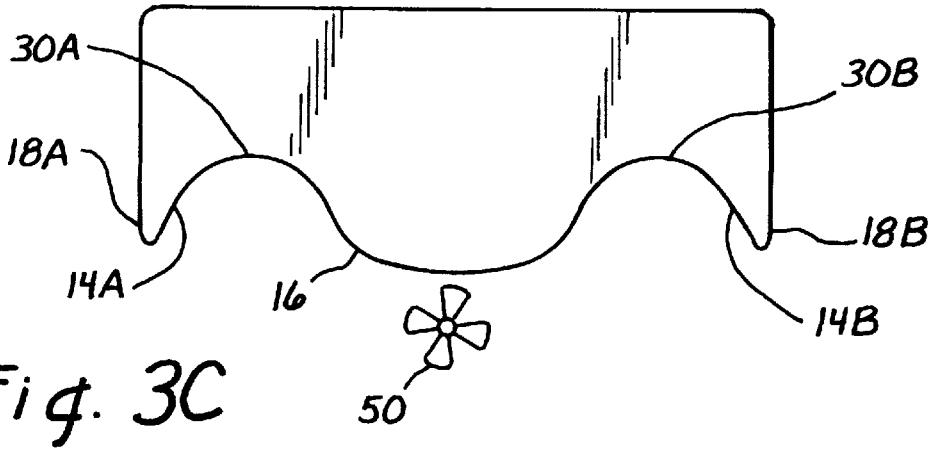
Fig. 3C

Fig. 6A
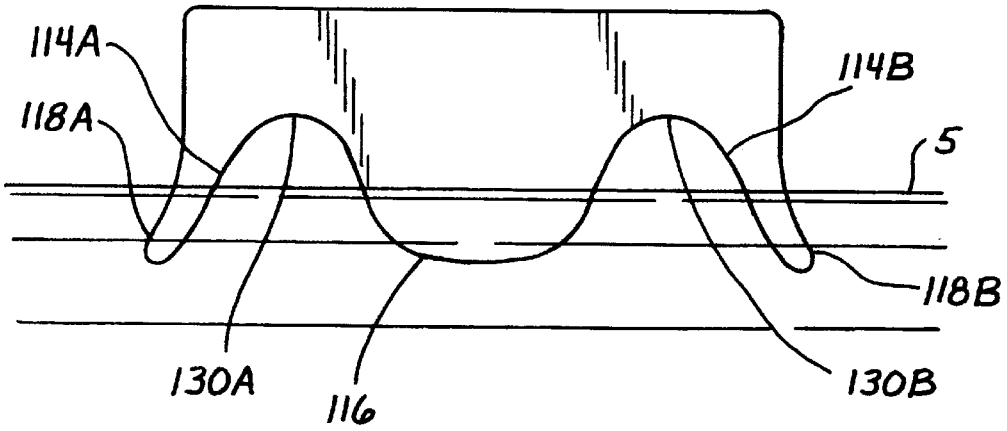
Fig. 6B
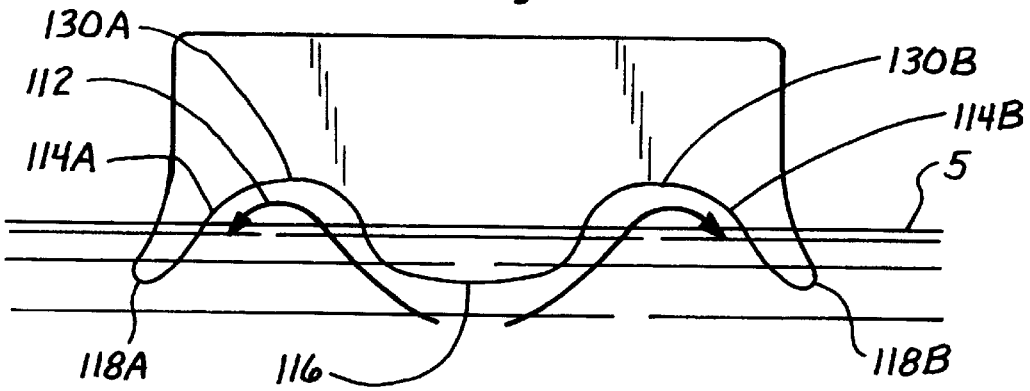
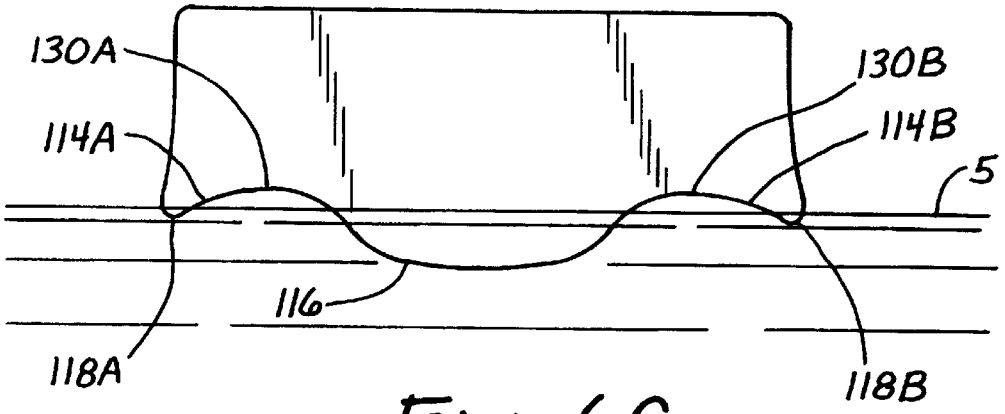
Fig. 6C

M-SHAPED BOAT HULL

CROSS REFERENCES TO RELATED APPLICATIONS

This application is a continuation-in-part of commonly assigned U.S. patent application Ser. No. 09/399,468 now U.S. Pat. No. 6,250,245 issued Jun. 26, 2001, filed by the same inventors Sep. 20, 1999, which application claims the benefit of U.S. Provisional Application Ser. No. 60/101,353 filed by the same inventors Sep. 22, 1998.

BACKGROUND OF THE INVENTION

1. Technical Field

This invention relates generally to watercraft, and more particularly to a motorboat or sailboat form of watercraft having at least one displacement body that produces a bow wave.

2. Description of Related Art

Motor and sail powered displacement boats generate a bow wave, followed by a trough and stem wave, due to hull form and friction. For a displacement boat, the bow wave increases in amplitude with boat speed until propulsion power is insufficient to climb the wave (i.e., the hull speed limit). The bow wave, when generated, initially moves forward at the hull speed, but eventually loses speed and moves at an angle away from the hull. When the bow wave does so, it has sufficient energy to threaten other nearby boats and cause damage to foundations at the water/land interface in narrow waterways. In addition, engines mounted on the stem of the boat generate strong propeller wave action and noise pollution, which are especially objectionable to residences and/or commercial buildings located near the water/land interface. These problems are accentuated when boats operating at low speeds are required to make sharp-angle turns in narrow waterways, such as in the canals of Venice, Italy. Because a rudder is less effective under such conditions, an articulating outboard motor (or propeller), which accentuates the generation of waves and noise pollution, may be required.

The problems associated with the operation of smaller displacement boats powered by stern-mounted internal combustion engines include:

1. Conventional power boats are designed as either: (a) displacement boats, efficient at low speeds but with sufficient power and planing surface to transcend the hull speed limits; or (b) planing boats, inefficient at low speed but with sufficient power and planing surface to transcend the hull speed limits;
2. As mentioned above, bow waves generated by a boat move forward initially at the boat speed, but thereafter at decreasing speed due to friction, leading to potentially destructive bow waves moving laterally away from the boat;
3. A significant portion of propulsion energy is lost when converted into wave energy, leading to inefficiency;
4. Bow and stern waves plus stern-mounted propeller wave action generated by boats operating at high speed can cause serious damage to other boats and to foundations at the water/and interface in narrow waterways and small lakes; and
5. Wave, noise, and air pollution generated by conventional displacement boats powered by internal combustion engines are accentuated with an articulating outboard motor or propeller.

Conventional twin-hull catamarans, motor or sail powered, are also displacement boats that generate bow waves followed by troughs and stern waves due to hull form and friction. They offer certain advantages over conventional mono-hull watercraft in their high lateral stability and reduced form and friction drag. Although increasingly popular, both sail and motor powered conventional catamarans suffer important disadvantages. Among other things, motor powered catamarans generate large bow waves at high speeds which threaten other nearby boats and foundations at the water/land interface. In addition, they generate substantial external noise pollution. Furthermore, neither motor or sail powered catamarans recover energy from the bow waves and thus they remain displacement boats and this limits propulsion efficiency at higher speeds.

SUMMARY OF THE INVENTION

It is a general objective of the present invention to minimize damage to foundations at the water/land interface and to reduce the disruptive heaving motion to waterborne vessels and structures from boat-generated waves through operation of a watercraft having an approximately "M-shaped" hull that is designed to suppress such wave action.

It is a further objective in certain embodiments of the present invention to provide a powerboat having a relatively narrow central displacement body and planing wings to operate efficiently at low speed in the displacement mode, while requiring less power for efficient transfer into the planing mode, thereby providing efficient planing at high speed.

It is a further objective in other embodiments to recapture boat-generated waves through extension from the central displacement body of planing wings and parallel tapered outer skirts having vertical outboard and curved inboard surfaces to direct both the bow and skirt waves into channels in the planing wings.

It is a further objective to recover energy from the boat-generated waves (which are recaptured by the wing channels and tapered outer skirts) through planing on these waves, thereby recovering some portion of their contained energy.

It is a further objective in certain embodiments to provide improved stability at low boat speeds by installing at the outer edge of the planing wing a tapered outer skirt extending downward below the water line.

It is a further objective in certain embodiments to provide inner skirts attached to both sides of the displacement body to aerate the water along the hull to reduce frictional drag and to minimize wave energy behind the boat.

It is a further objective to increase dispersion of the wave energy exiting the boat by installing hydrodynamic serrations on the underside of the displacement body and/or the wing channels, preferably generally aligned with the outer and inner skirts and propeller discharge.

It is a further objective to reduce noise and air pollution by replacing transom-mounted engines with internal combustion, electric, or compressed air motors mounted in the wing channels and/or on the central displacement body.

It is a further objective to adapt the "M-shaped" hull to a sailboat with twin wing channels to provide righting moment from the higher lee-side bow wave and an automatic adjustment of side force with increasing immersion of the lee-side skirt.

The foregoing objectives are achieved by using an "M-shaped" watercraft hull. The present invention provides in certain embodiments a watercraft comprising a hull having a fore end, an aft end, and a longitudinal axis extending between the fore end and the aft end. The hull comprises a displacement body and two downwardly extending outer skirts. Each of the outer skirts is located outside of the displacement body and is connected thereto by a planing wing having a wing channel. The ceilings (i.e., apices) of the wing channels are above the static waterline in the fore end and extend downward below the static waterline in the aft end. Preferably, the displacement body is approximately centralized, extending substantially along the central longitudinal axis of the hull. The wing channels are preferably generally arcuate and concave with respect to the static waterline.

It is a general objective of another aspect of the invention to provide a multi-hull watercraft (e.g., a catamaran) with the advantages outlined above.

It is a further objective to use skirts to form two wing channels for each of the hulls (e.g., a total of four wing channels for a twin-hull catamaran) in order to recapture the bow waves and thereby protect nearby boats and structures at the water/land interface.

It is a further objective to create a concave bow shape for generating a spiral motion of the bow waves in order to entrap entering air and force it down the wing channels into the aft "pressure" section to form an air cushion for efficient boat planing. This converts a conventional multi-hull watercraft from a "displacement" boat to an "air cushion" watercraft for more efficient operation at higher speeds.

It is a further objective to utilize the air/water mixture flowing through the wing channels to dampen engine noise which is a source of increasing complaints from residents along restricted water ways.

It is a further objective to use the multi-hull catamaran with M-shaped hulls as a means of expanding the size of the single-hull watercraft with M-shaped hull described above without significant increase in the width and height of the wing channel entrance. This is important for ensuring a tight spiraling of the bow wave for efficient entrapment and forming of the entering air through the wing channel achieved with the single-hull watercraft with M-shaped hull described above. These objectives are achieved with a multi-hull watercraft having M-shaped hulls as subsequently described and claimed.

BRIEF DESCRIPTION OF THE DRAWINGS

FIG. 3A–C show the powerboat hull section, depicting the central displacement body with wing channels and tapered outer skirts to capture and suppress the bow wave. FIG. 3A shows twin motors in the wing channels; FIG. 3B shows twin motors on the displacement body; and FIG. 3C shows a single motor on the displacement hull.

FIG. 6A shows the sailboat bow section depicting the wing channels, wing channel ceilings, central displacement body and skirts curved outwards at the tip to each side force;

FIG. 6B shows the mid-section depicting the bow wave;

FIG. 6C shows the aft section.

DETAILED DESCRIPTION OF PREFERRED EMBODIMENTS OF THE INVENTION

The present invention is predicated on the realization that a boat propelled by motor or sail generates bow waves containing energy. With a conventional hull design, this energy is not only lost, thereby reducing efficiency, but also threatens other boats and damage to structures at the water/land interface. The "M-shaped" hull of the present invention recaptures the bow waves not only to protect other boats and structures at the water/land interface, but also to enhance boat efficiency. In the following detailed description, certain preferred embodiments of the present invention are described structurally first and then the general operation is provided.

Figure 1:
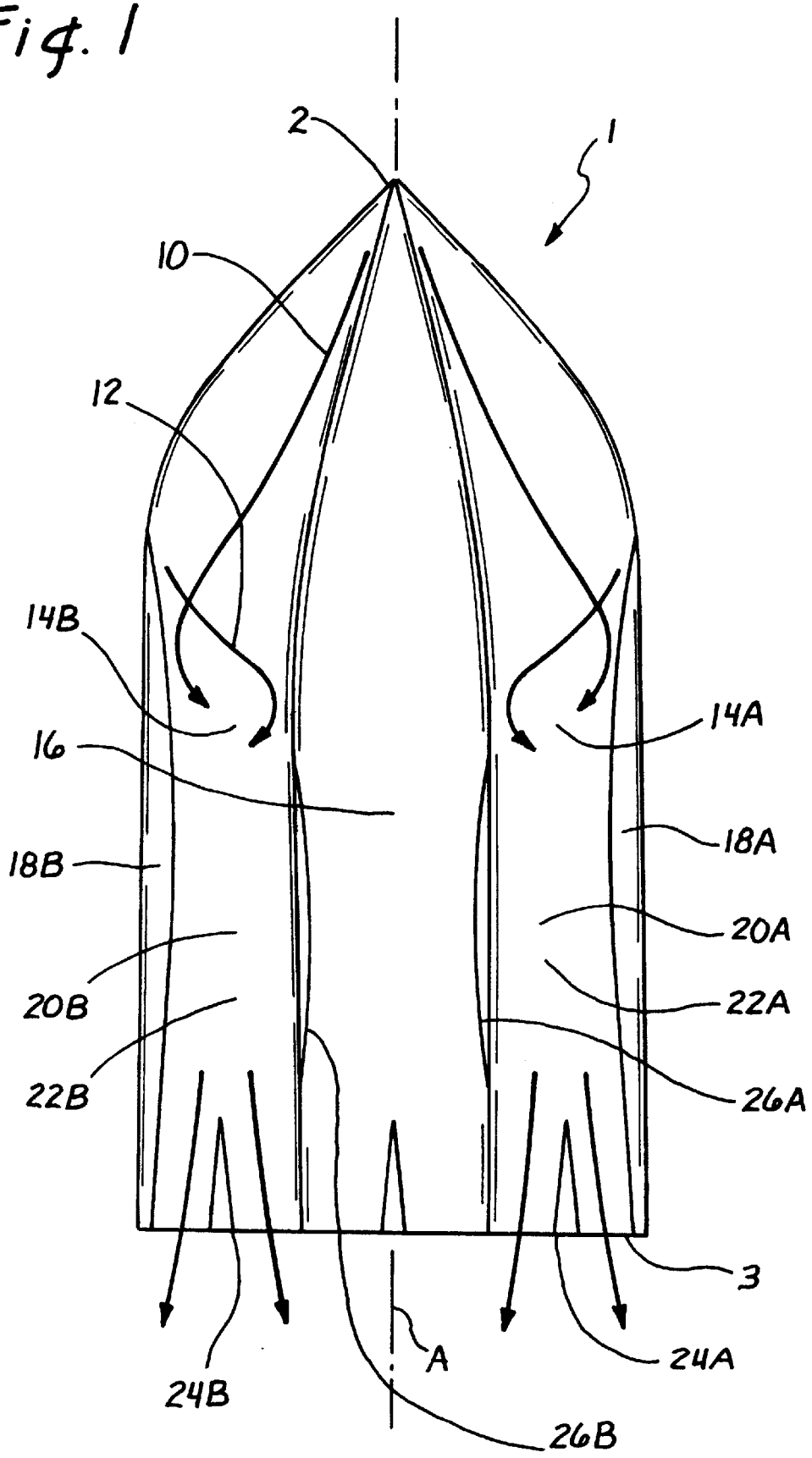
FIG. 1 shows a plan view of an "M-shaped" powerboat hull, depicting large bow waves, small skirt waves, planing wings, "spiral channel" sections on the planing wings, a central displacement body, tapered outer and inner skirts, wing channels formed in the planing wings, and hydrodynamic serrations, both on the central displacement body and in the wing channels.
Figure 2:
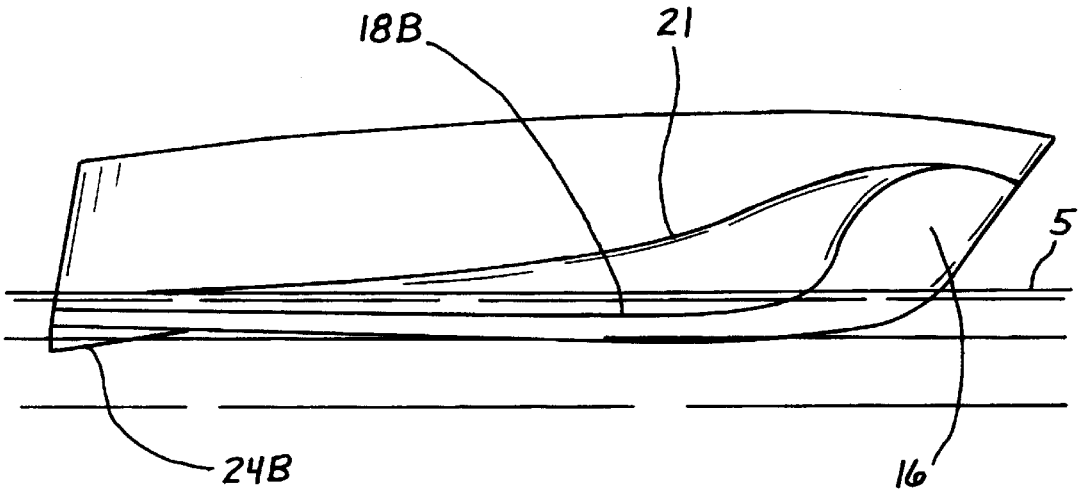
FIG. 2 shows a powerboat hull profile, depicting a central displacement body and tapered outer skirts that capture the bow wave, and the line of the planing wings and recapture wave energy.

Referring initially to FIGS. 1 and 2, the present invention provides a powerboat comprising an "M-shaped" hull 1 having a fore end 2, and aft end 3, and a longitudinal axis (designated by a reference number A in FIG. 1) extending between the fore end 2 and the aft end 3. The hull 1 includes a displacement body 16, which is preferably relatively narrow and centralized, and two downwardly extend outer skirts in the form of a port skirt 18A and a starboard skirt 18B. The outer skirts 18A and 18B are preferably generally parallel. The displacement body 16 provides displacement lift for efficient operation at low speeds. The outer skirts 18A and 18B are located on either side of the displacement body 16, the port skirt 18A being located on a port side of the displacement body 16 and the starboard skirt 18B being located on a starboard side of the displacement body 16 as illustrated in FIG. 1. Lateral extensions of the watercraft deck outward from the central displacement body 16 form two planing wings, a port planing wing 20A and a starboard planing wing 20B. The planing wing line 21 is shown in FIG. 2. The outer skirts 18A and 18B are connected to the displacement body 16 by the planing wings 20A and 20B to form first and second channel-defining structures that define first and second (i.e., port and starboard) wing channels 14A and 14B. The bow waves 10 and the smaller skirt waves 12 are directed into the wing channels 14A and 14B, wherein the waves undergo spiral action.

The outer (i.e., outboard) surfaces of the outer skirts 18A and 18B are preferably substantially perpendicular with respect to the static waterline 5 (FIG. 2) to minimize wave generation. The outer skirts 18A and 18B are also preferably generally arcuate (i.e., curved) on their inner surfaces (i.e., inboard), so as to form arcuate wing channels 14A and 14B with the displacement body 16. Most preferably, the outer skirts 18A and 18B are tapered. In operation, the wing channels 14A and 14B recapture the bow waves 10, thereby protecting other boats and waterway walls and providing effective planing surfaces 22A and 22B for efficient operation at high speed.

In preferred embodiments (see FIGS. 3A–C), the cross-sectional surface of each wing channel 14A and 14B is concave with respect to the static waterline 5. More preferably, the cross-sectional surface of each wing channel 14A and 14B at the fore end 2 is generally arcuate. Preferably, the curvature of the cross-sectional surface of each wing channel 14A and 14B is greater at the fore end 2 than at the aft end 3. The curvature preferably progressively decreases from the fore end 2 to the aft end 3. In particularly preferred embodiments, the cross-sectional surface of each wing channel 18A and 18B is generally arcuate at the fore end 2 and generally linear (i.e., "flat") at the aft end 3. The wing channel ceilings 30A and 30B (i.e., apices) are above the static waterline 5 in the fore end 2 and extend downward below the static waterline 5 in the aft end 3.

Referring again to FIG. 1, the watercraft of the present invention may have a hull 1 that further comprises two or more downwardly extending inner skirts (a port inner skirt 26A and a starboard inner skirt 26B) attached to either side of the displacement body 16, wherein the outer skirts 18A and 18B flank the inner skirts 26A and 26B. In certain embodiments, as described in greater detail below, these inner skirts 26A and 26B can reduce cavitation caused by propeller action.

Preferably, the hull 1 further comprises one or more hydrodynamically-shaped serrations 24A and 24B located on the surface of the wing channels 14A and 14B (at the aft end 3) and extending downward below the static waterline 5 (FIG. 1). The one or more serrations are preferably located on the wing channel ceiling (see reference numerals 30A and 30B in 15 FIGS. 3A–C). Alternatively, the hull may further comprise one or more hydrodynamic serrations 25 (FIG. 1) located on the surface of the displacement body 16 and extending downward below the static waterline 5. The serrations 24A, 24B, and 25 provide wake control. To more effectively disperse both the remaining bow wave energy exiting from the wing channels 14A and 14B and the propeller wake energy, the hydrodynamically-shaped serrations are preferably mounted under, and extend forward of, the transom which is generally aligned with the outer and inner skirts and propeller(s) discharge. This design disperses the wave flow and increases the mixing of air and water, with the air dampening the transmission of energy in the water, thereby further reducing the threat to other boats or damage to structures at the water/land interface.

The present invention also provides in certain embodiments a watercraft wherein upon forward movement of the watercraft through a body of water, the waves generated by the displacement body 16 and the outer skirts 18A and 18B are substantially directed into the wing channels 14A and 14B, resulting in substantial wave suppression.

The watercraft of the present invention may be a powerboat (as illustrated in FIGS. 1, 2, and 3A–C) or a sailboat (as illustrated in FIGS. 4, 5, 6A–C, and 7). Where the watercraft is a powerboat, the watercraft preferably comprises a mechanical propulsion system. The mechanical propulsion system may be an internal combustion system, an electrical system, a compressed air system, a water jet system, or a combination thereof Preferably, the mechanical propulsion system comprises one or more propellers. Referring to FIGS. 3A–C, the propeller(s) 50 may be located on the displacement body 16 (see FIGS. 3B and 3C) or on a planing wing (e.g., in a wing channel). In the case where the propellers are located in the wing channels (see FIG. 3A), it is preferred that there be two propellers, wherein each of the two propellers =is located in a wing channel 14A or 14B.

Twin propellers 50 mounted below the wing channels 14A and 14B provide efficient propulsion and maneuvering at lower speeds, as in FIG. 3A. However, with increased speeds, the turbulent air/water mixture, which is desirable for lift efficiency in the wing channels 14A and 14B, also creates propeller cavitation. To resolve this cavitation problem, the air/water mixture flowing through the wing channels 14A and 14B can be isolated for increased lift efficiency by installing two inner skirts 26A and 26B (preferably generally perpendicular to the static waterline 5 and parallel to the outer skirts 18A and 18B), as illustrated in FIG. 1. Preferably, the inner skirts 26A and 26B are faired into the central displacement body 16 near the point of its maximum beam and extend beyond the propeller(s), thereby forming an inner wall to contain the air/water mixture. This inner skirt design assures solid water flow under the central displacement body 16 in which either a single (see FIG. 3C) or twin propellers (see FIG. 3B) may operate efficiently at higher speeds without cavitation. For propellers mounted on the central displacement body 16, satisfactory boat maneuvering may be achieved with a large single rudder directly aft of a single propeller or twin rudders mounted in the discharge from the two propellers, in either case mounted forward of the transom. Alternatively, where two propellers are used, maneuverability may be controlled by separate control of speed and direction of rotation for each propeller.

Having described the structure of various preferred embodiments of the present invention, the operation of such watercraft is described below. In operation, the bow waves 10, which are moved forward by the boat at its speed, are forced into the wing channels 14A and 14B and given a spiral motion by the concave surface of the wing channels 14A and 14B. The water then spirals back through the wing channels with reduced angularity as its forward speed is slowed by friction. Air near the entrance to the wing channels, increasing in pressure with boat speed, is entrapped in the water spiral which acts as screw conveyor, moving the air with the water in a spiral pattern through approximately the first two-thirds of the length of the wing channels 14A and 14B referred to as the "spiral action." Although its speed is reduced by friction, the air/water mixture continues to move forward in relation to water outside the wing channels. This water action contributes to efficient planing lift of the ceilings of the wing channels, with the air content also providing a benefit in reduced friction drag.

As the air/water mixture leaves the "spiral section" (see reference numeral 14 in FIG. 1), it passes into the final approximately one-third of the wing channel that, in certain preferred embodiments, becomes increasingly rectangular with a flattening (e.g., decreased curvature) of the wing channel ceiling. The wing channel ceilings slope downward to below the static waterline 5, reducing and ultimately eliminating the cross-sectional area, thereby increasing the pressure of the air/water mixture. These changes in what is referred to as the "pressure section" (see reference numerals 22A and 22B in FIG. 1) eliminate the spiral flow and force separation of the air which rises towards the wing channel ceiling due to its lower specific gravity. The water, under increasing pressure, compresses the air layer at the wing channel ceiling, thereby providing efficient low-drag planing lift. Finally, the compressed air/water mixture exits under the transom as low energy foam, while the lower solid water layer, from which much of the energy has been extracted in compressing the air, exits the transom below the foam.

Figure 4:
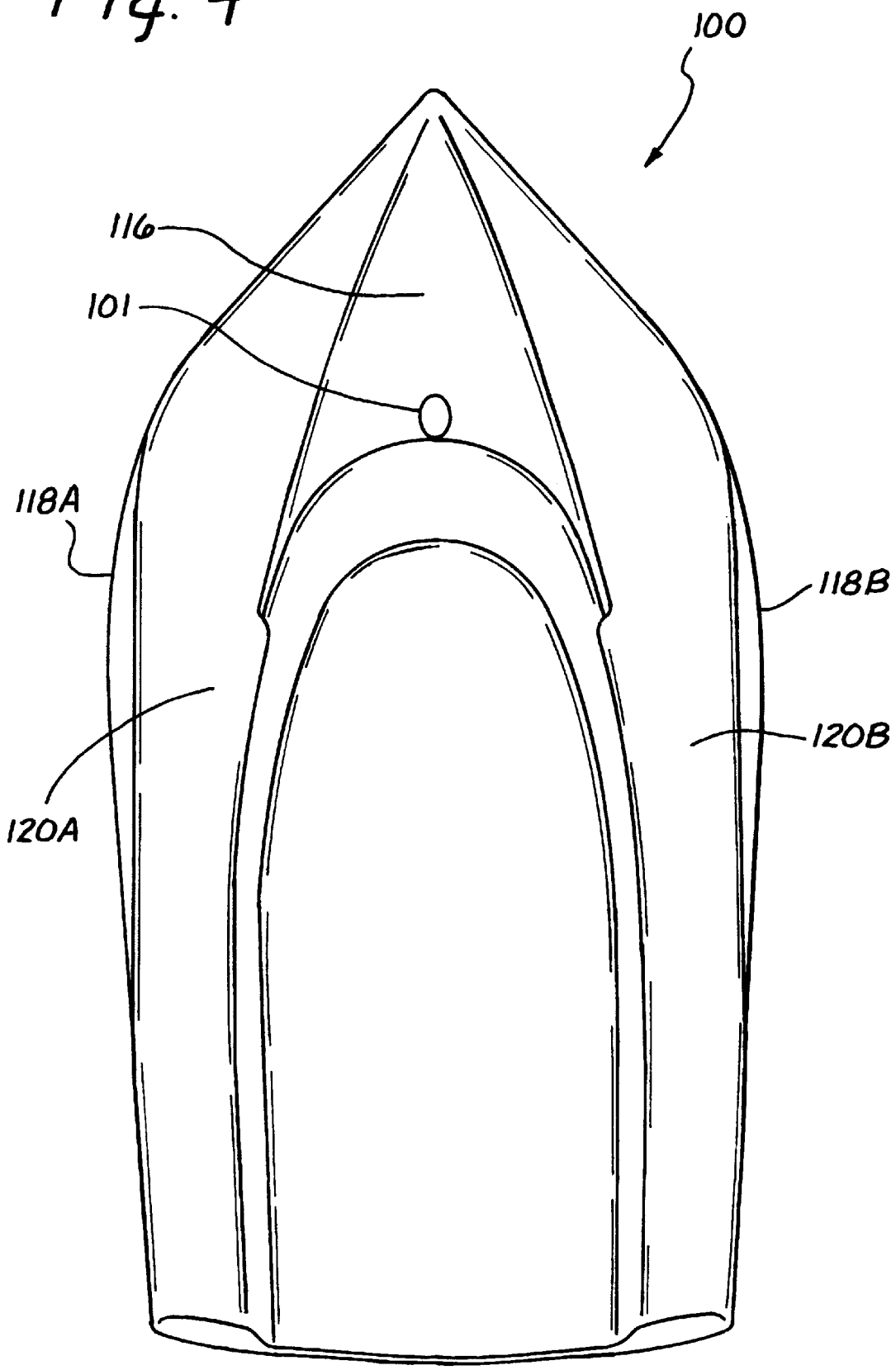
FIG. 4 shows a plan view of an "M-shaped" sailboat hull, depicting a central displacement body, planing wings and tapered skirt for side force and bow wave capture.
Figure 5:
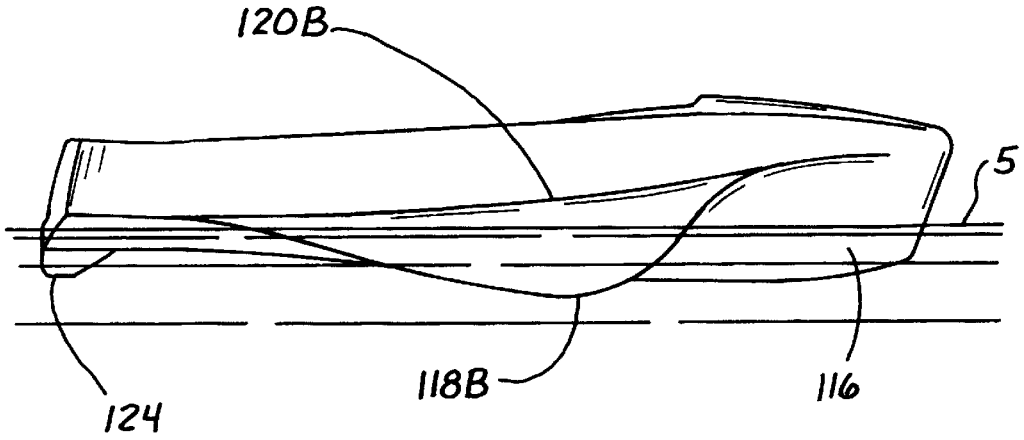
FIG. 5 shows a sailboat hull profile view, depicting the central displacement body, planing wings and tapered outer skirts for side force and bow wave capture.
Figure 7:
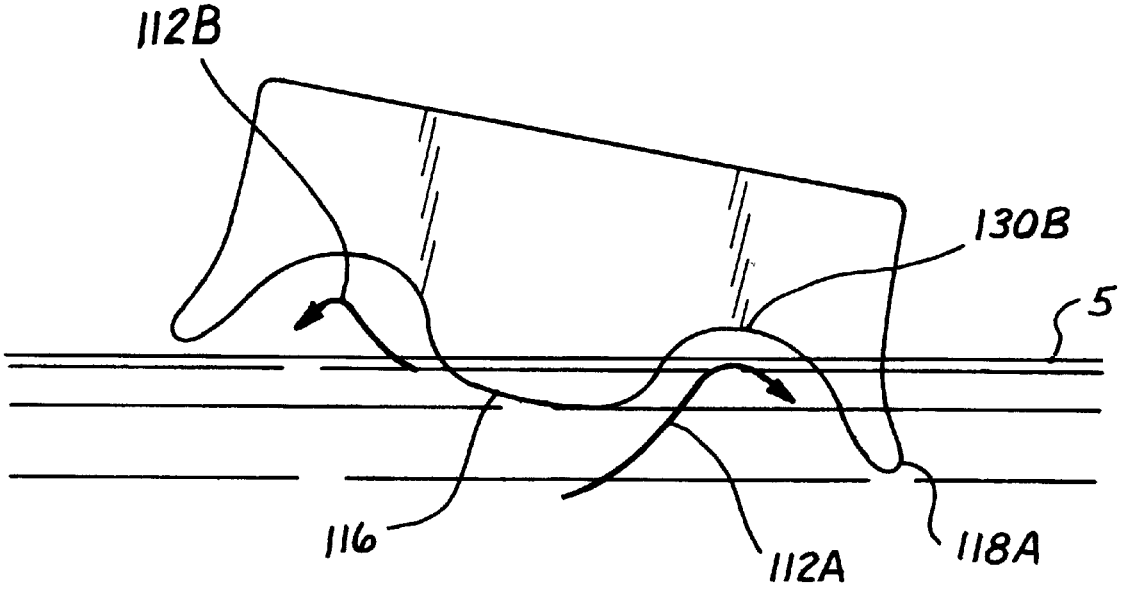
FIG. 7 shows the sailboat heeled mid-section, depicting the skirt increasing side force with heel, greater bow wave righting moment, and the lesser bow wave.

As mentioned above, the hull design provided by the present invention can also be adapted for use in a sailing vessel, as shown in FIGS. 4–7. A sailboat design incorporating an "M-shaped" hull 100 having a sailing mast 101 is illustrated in FIG. 4. Referring to FIGS. 4–7, such a sailboat has the following features:

1. A narrow displacement body 116 for efficient sailing at low speeds;
2. Planing wings 120A and 120B with ceilings 130A and 130B to provide stability from bow waves 112 (FIG. 6B) and to promote planing;
3. Righting moment from the lift on the lee-side bow wave 112*a* on the wing ceiling 130B, which increases with boat heel (lesser bow wave 112*b* and greater bow wave 112*a*, which increases the righting moment, are shown in FIG. 7)
4. Outer skirts 118A and 118B (preferably tapered) to contain the bow wave and provide automatic adjustment of side force with heel and increasing immersion of the skirt having a curved tip to enhance side force (see FIG. 7); and
5. Wing ceilings 130A and 130B sloped downward aft to the transom for efficient planing (see FIGS. 6A–C).

As with the powerboat embodiments described above, hydrodynamic serrations 124 may be mounted on the underside of the sailboat 100. As shown in FIGS. 6A–C, the wing channel ceilings 130A and 130B preferably decrease in height and the curvature of the wing channels 114A and 114B decreases, moving from the bow section (FIG. 6A) to the mid-section (FIG. 6B) to the aft section (FIG. 6C). As shown in FIG. 6C, the outer skirts 118A and 118B preferably decrease in length toward the aft end of the hull to provide efficient planing surfaces.

Figure 8:
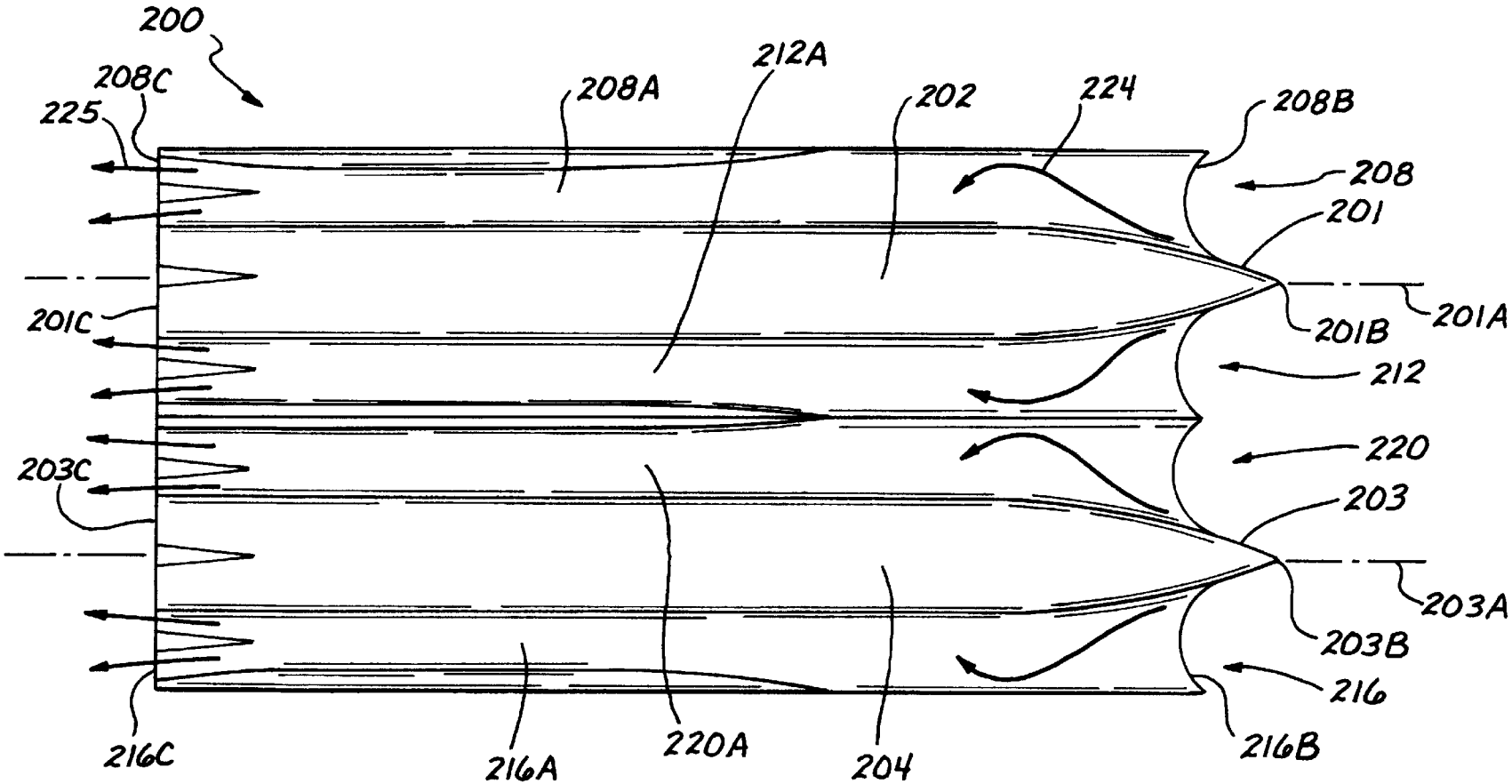
FIG. 8 shows a plan view of a twin-hull catamaran with multiple shaped hulls, depicting large bow waves, small internal skirt waves, planing wings, spiral channel sections on the planing wings, two central displacement bodies, tapered outer and inner skirts, wing channels formed in the planing wings, and hydrodynamic serrations, both on the central displacement bodies and in the wing channels.
Figure 9:
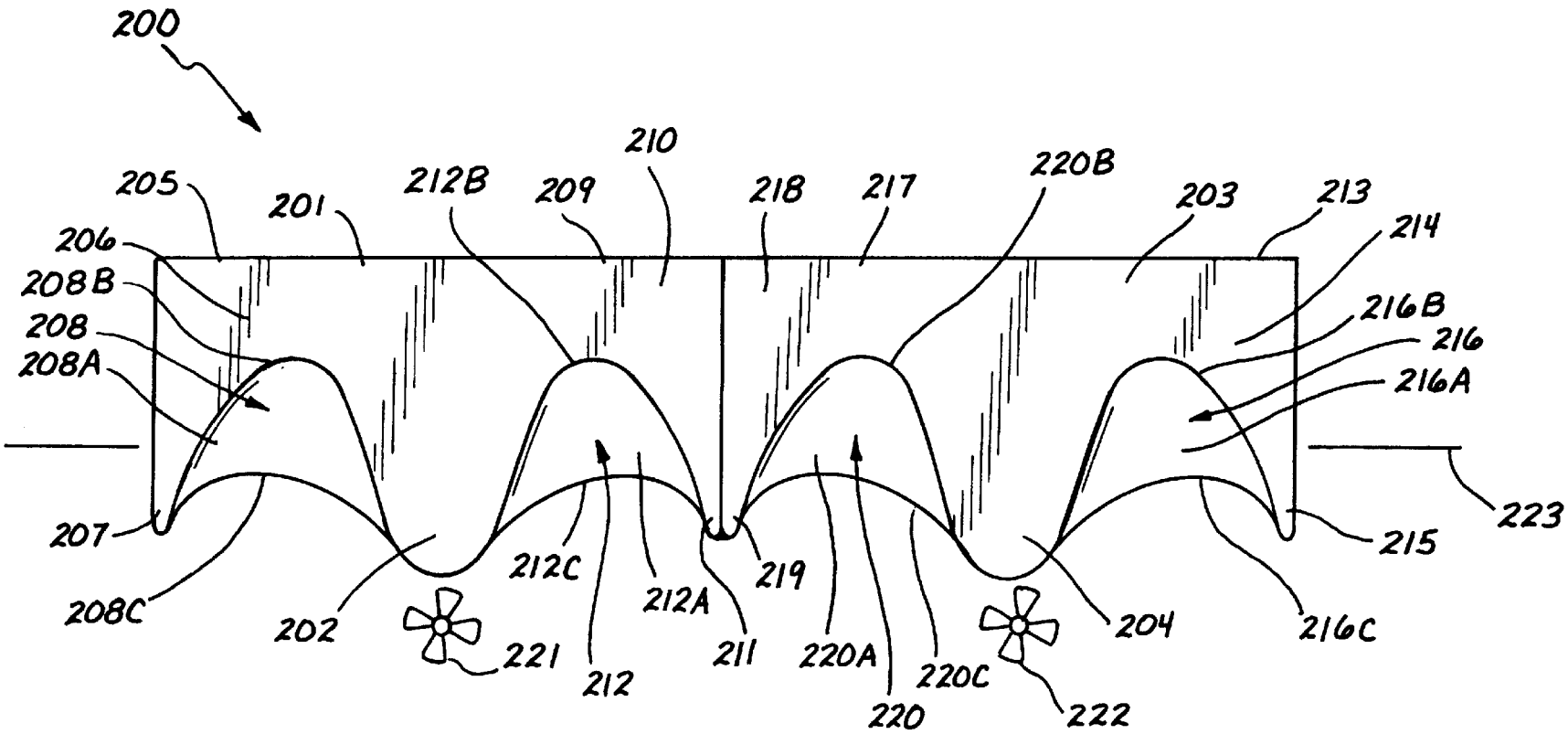
FIG. 9 shows an enlarged transverse section of the motored twin-hull catamaran with M-shaped hulls, depicting the two central displacement body portions, four wing channels, and tapered skirts that capture and suppress the bow waves; two propellers are shown, one mounted on each of the two central displacement bodies.

Referring now to FIGS. 8 and 9, they show a multi-hull watercraft with M-shaped hulls constructed according to the invention in the form of a twin-hull catamaran 200. Although the catamaran 200 includes two M-shaped hulls, a multi-hull watercraft constructed according to the invention may have more than two hulls. The catamaran 200 includes a first hull 201 with a first displacement body 202 and a second hull 203 with a second displacement body 204. The first hull 201 extends along a first longitudinal axis 201A (FIG. 8) between a fore end 201B and an aft end 201C of the first hull, and the second hull 203 extends along a second longitudinal axis 203A between a fore end 203B and an aft end 203C of the second hull. Each of the hulls 201 and 203 is similar in many respects to the M-shaped hull 1 previously described, and so only differences are focused upon in the following description.

A first outboard channel-defining structure 205 (FIG. 9) that is part of the first hull 201 includes a first outboard wing 206 and a downwardly extending first outboard skirt 207 that cooperatively define a first outboard wing channel 208. As is apparent from FIGS. 8 and 9, these elements are to "outboard" in the sense that the first outboard skirt 207 occupies a position disposed outwardly from the first displacement body 202 such that the first displacement body 202 is disposed intermediate the first outboard wing 207 and the second displacement body 204. A first inboard channel-defining structure 209 that is also part of the first hull 201 includes a first inboard wing 210 and a first inboard skirt 211 that cooperatively define a first inboard wing channel 212. These elements are "inboard" in the sense that the first inboard skirt 211 occupies a position disposed inwardly from the first displacement body 202 such that the first inboard skirt 211 is disposed intermediate the first displacement body 202 and the second displacement body 204. Similarly, a second outboard channel-defining structure 213 that is part of the second hull 203 includes a second outboard wing 214 and a downwardly extending second outboard skirt 215 that cooperatively define a second outboard wing channel 216. These elements are "outboard" in the sense that the second outboard skirt 211 occupies a position disposed outwardly from the second displacement body 204 such that the second displacement body 204 is disposed intermediate the second outboard wing 207 and the first displacement body 202. A second inboard channel-defining structure 217 that is also part of the second hull 203 includes a second inboard wing 218 and a second inboard skirt 219 that cooperatively define a second inboard wing channel 220. These elements are "inboard" in the sense that the second inboard skirt 219 occupies a position disposed inwardly from the second displacement body 204 such that the second inboard skirt 219 is disposed intermediate the second displacement body 204 and the first displacement body 202.

The wing channel 208 includes a wing channel ceiling 208A that extends from a forward portion 208B of the wing channel ceiling to an aft portion 208C (FIGS. 8 and 9), and the wing channel 212 includes a wing channel ceiling 212A that extends from a forward portion 212B of the wing channel ceiling 212A to an aft portion 212C. Similarly, the wing channel 216 includes a wing channel ceiling 216A that extends from a forward portion 216B of the wing channel ceiling 216A to an aft portion 216C, and the wing channel 220 includes a wing channel ceiling 220A that extends from a forward portion 220B of the wing channel ceiling 220A to an aft portion 220C.

A first propeller 221 (FIG. 9) is mounted on the displacement body 202 and a second propeller 222 is mounted on the displacement body 204. Thus, the catamaran 200 is a motor powered watercraft, although FIGS. 8 and 9 are intended to also illustrate gernane aspects of a sail powered multi-hull watercraft constructed according to the invention. Reference numeral 223 designates the static waterline.

Thus, the catamaran 200 is a multi-hull watercraft (i.e., a watercraft having two or more hulls), each hull having a displacement body flanked by channel-defining structures that define wing channels and include downwardly extending skirts that capture bow waves and direct them spiraling rearward within the wing channels as previously described with reference to the single M-Shaped hull 1. In other words, the catamaran 200 has two M-shaped hulls and four arcuate channels adapted to contain the spiraling bow waves from the two central displacement bodies, thus to increase lateral stability and to suppress boat waves to protect nearby boats and structures at the water/land interface. This action is illustrated in fig. 8 by arrows at the fore end of the catamaran 200 (one arrow 224 being designated) that depict incoming bow waves, and arrows at the aft end (one arrow 225 being designated) that depict energy-dissipated aerated water exiting the aft end of the wing channels.

We claim:

1. A watercraft comprising:

a first hull having a fore end, an aft end, and a longitudinal axis extending between the fore end and the aft end;

a displacement body portion of the first hull that extends between the fore end and the aft end, the displacement body having a static waterline, a port side, and a starboard side;

a first channel-defining structure portion of the first hull that is located on an outboard side of the displacement body, including a first wing structure extending laterally from the outboard side of the displacement body above the static waterline and a first outer skirt structure that extends downwardly from the first wing structure to below the static waterline in spaced apart relationship to the displacement body, said first outer skirt structure having an outer surface that is substantially perpendicular with respect to the static waterline and said first channel-defining structure defining a first channel with a cross-sectional surface that is generally arcuate; and a second channel-defining structure portion of the first hull that is located on an inboard side of the displacement body, including a second wing structure extending laterally from the inboard side of the displacement body above the static waterline and a second outer skirt structure extending perpendicularly downwardly from the second wing structure to below the static waterline in spaced apart relationship to the displacement body, said second outer skirt structure having an outer surface that is substantially perpendicular with respect to the static waterline and said second channel-defining structure defining a second channel with a cross-sectional surface that is generally arcuate;

the first and second channels extending from the fore end to the aft end of the first hull and the first and second channels being adapted to capture a bow wave and to cause air and water to mix and spiral toward the aft end of the first hull as compressed aerated water, thereby reducing friction drag, increasing lateral stability, and dampening transmission of bow wave energy at the aft end of the first hull; and a second hull that is similar to the first hull, the second hull being connected to the first hull to form a multihull watercraft and the second hull defining third and fourth channels similar to the first and second channels, said third and fourth channels being adapted to capture a bow wave and to cause air and water to mix and spiral toward an aft end of the second hull as compressed aerated water in order to thereby reduce friction drag, increasing lateral stability, and dampening, transmission of bow wave energy at the aft end of the second hull.

2. A watercraft as recited in claim 1, wherein each of the first and second outer skirt structures has an outer surface and said outer surfaces are substantially perpendicular with respect to the static waterline both above and below the static waterline, said surfaces are straight longitudinally, and said surfaces are parallel to the longitudinal axis of the hull.

3. A watercraft as recited in claim 1, wherein the first and second skirt structures have inner surfaces that are generally arcuate.

4. A watercraft as recited in claim 1, wherein first and second outer skirt structures are tapered inward only to form arcuate first and second channels.

5. A watercraft as recited in claim 1, wherein each of the first and second channels has a cross-sectional surface that is concave with respect to the static waterline.

6. A watercraft as recited in claim 5, wherein each of the first and second channels has a cross-sectional surface at the fore end that is generally arcuate.

7. A watercraft as recited in claim 6, wherein the cross-sectional surface of each of the first and second channels has a curvature that is greater at the fore end than at the aft end.

8. A watercraft as recited in claim 1, wherein each of the first and second channels has a cross-sectional surface that is generally arcuate at the fore end and generally linear at the aft end.

9. A watercraft as recited in claim 1, wherein each of the first and second channels has a surface that includes a serration extending downward below the static waterline.

10. A watercraft as recited in claim 1, wherein the displacement body has an undersurface and at least one serration on said surface that extends downward below the static waterline to disperse the propeller wake.

11. A watercraft as recited in claim 1, wherein the first and second channels are so adapted that upon forward movement of the watercraft through a body of water the waves generated by the displacement body and the first and second outer skirt structures are substantially directed into the first and second channels, resulting in substantial wave suppression.

12. A watercraft as recited in claim 11, wherein the watercraft comprises a mechanical propulsion system.

13. A watercraft as recited in claim 12, wherein the mechanical propulsion system includes at least one of an internal combustion system, an electrical system, a compressed air system.

14. A watercraft as recited in claim 12, wherein the mechanical propulsion system includes at least one propeller.

15. A watercraft as recited in claim 14, wherein at least one propeller is located on the displacement body.

16. A watercraft as recited in claim 14 having two propellers, wherein a first one of the two propellers is located in the first channel and a second one of the two propellers is located in the second channel.

17. A watercraft as recited in claim 1, wherein the hull further comprises at least a first inner skirt attached to the port side of the displacement body inboard of the first outer skirt structure and at least a second inner skirt attached to the starboard side of the displacement body inboard of the second outer skirt structure, said first and second inner skirts being adapted to isolate aerated water in the first and second channels from solid water flowing under the displacement body in order to thereby help prevent propeller cavitation.

18. A watercraft as recited in claim 1, wherein the watercraft is a sailboat.

19. A watercraft as recited in claim 18, wherein each of the first and second outer skirt structures has a tip that extends outward relative to the longitudinal axis.

20. A watercraft as recited in claim 18, wherein each of the first and second outer skirt structures has a surface with at least a portion that curves outward relative to the longitudinal axis.

21. A watercraft, comprising:

a first hull having a displacement body with a bow, an outboard side, and an inboard side;

a first channel-defining structure portion of the first bull that is located on the outboard side of the displacement body, including a first wing structure extending laterally from the outboard side of the displacement body above the static waterline and a first outer skirt structure extending perpendicularly downwardly from the first wing structure to below the static waterline in spaced apart relationship to the displacement body, said first outer skirt structure having an outer surface that is substantially perpendicular with respect to the static waterline and said first channel-defining structure defining a first channel with a cross-sectional surface that is generally arcuate; and a second channel-defining structure portion of the first hull that is located on the inboard side of the displacement body, including a second wing structure extending laterally from the starboard side of the displacement body above the static waterline and a second outer skirt structure extending perpendicularly downwardly from the second wing structure to below the static waterline in spaced apart relationship to the displacement body, said second outer skirt structure having an outer surface that is substantially perpendicular with respect to the static waterline and said second. channel-defining structure defining a second channel with a cross-sectional surface that is generally arcuate;

the first and second channels being adapted to function as (i) means for directing bow waves generated by the bow into the first and second channels so as to reduce lateral wave pollution from the first hull, (ii) planing means for providing surfaces on which the first hull is capable of planing on the bow waves generated by the bow so as to recapture energy from said bow waves, and (iii) means for aerating water along the hull to reduce frictional drag and to reduce wave generation from an aft end of the first hull; and the watercraft including a second hull that is similar to the first hull, the second hull being connected to the first hull to form a multi-hull watercraft and the second hull defining third and fourth channels similar to the first and second channels, said third and fourth channels being adapted to function as (i) means for directing bow waves generated by a bow portion of the second hull into the third and fourth channels so as to reduce lateral wave pollution from the second hull, (ii) planing means for providing surfaces on which the second hull is capable of planing on the bow waves generated by the bow portion of the second hull so as to recapture energy from said bow waves, and (iii) means for aerating water along the second hull in order to reduce frictional drag and to reduce wave generation from an aft end of the second hull.

22. A watercraft; comprising:

at least two hulls of similar construction that are connected together to form a multi-hull watercraft, a first hull of the two hulls extending along a first longitudinal axis between a fore end and an aft end of the first hull, and a second hull of the two hulls extending along a second longitudinal axis between a fore end and an aft end of the second hull;

each hull of the two hulls having a displacement body portion that extends between the fore end and the aft end of the hull, and each displacement body portion having a static waterline, an outboard side, and an inboard side;

each hull of the two hulls having an outboard channel-defining structure that is located on the outboard side of the displacement body portion of the hull, each outboard channel-defining structure including an outboard wing structure extending laterally from the outboard side of the displacement body portion above the static waterline and an outboard skirt structure that extends downwardly from the outboard wing structure to below the static waterline in spaced apart relationship to the displacement body portion, each outboard channel-defining structure defining an outboard channel with a cross-sectional surface that is generally arcuate;

each hull of the two hulls having an inboard channel-defining structure that is located on the inboard side of the displacement body portion of the hull, each inboard channel-defining structure including an inboard wing structure extending laterally from the inboard side of the displacement body portion above the static waterline and an inboard skirt structure extending perpendicularly downwardly from the inboard wing structure to below the static waterline in spaced apart relationship to the displacement body portion, each channel-defining structure defining an inboard channel with a cross-sectional surface that is generally arcuate;

each of the outboard channels and each of the inboard channels extending from the fore end of a respective one of the first and second hulls to the aft end of the respective one of the first and second hulls, and each of the outboard channels and inboard channels being adapted to capture a bow wave and to cause air and water to mix and spiral toward the aft end of the respective one of the first and second hulls as compressed aerated water, thereby reducing friction drag, increasing lateral stability, and dampening transmission of bow wave energy at the aft end of the respective one of the first and second hulls.

23. A watercraft as recited in claim 21, wherein the watercraft is motor powered.

24. A watercraft as recited in claim 22, wherein the watercraft is sail powered.

* * * * *